US006666345B2

(12) United States Patent
Blanding

(10) Patent No.: US 6,666,345 B2
(45) Date of Patent: Dec. 23, 2003

(54) COMBINATION CAP FOR A BABY BOTTLE AND WATER BOTTLE

(76) Inventor: Marcy Blanding, 155 N. Singingwood St., #5, Orange, CA (US) 92869

( * ) Notice: Subject to any disclaimer, the term of this patent is extended or adjusted under 35 U.S.C. 154(b) by 0 days.

(21) Appl. No.: 10/087,381

(22) Filed: Feb. 28, 2002

(65) Prior Publication Data

US 2003/0160019 A1 Aug. 28, 2003

(51) Int. Cl.[7] ..... A61J 9/00
(52) U.S. Cl. ..... 215/11.1; 606/236
(58) Field of Search ..... 215/11.1, 11.3, 215/11.4, 11.5, 18; 220/550, 555, 523, 528; 606/234–236

(56) References Cited

U.S. PATENT DOCUMENTS 2,461,516 A 2/1949 Bullock
2,771,073 A 11/1956 Mills
3,214,053 A 10/1965 Roberson et al.
4,676,386 A * 6/1987 Phlaphongphanich ..... 215/11.1
4,815,615 A * 3/1989 Phlaphongphanich ..... 119/6.7
5,024,341 A 6/1991 Dekerle
5,253,900 A 10/1993 Snyder
5,353,964 A * 10/1994 Liu et al. ..... 222/134
D414,873 S 10/1999 Kwiecinski
6,415,937 B1 * 7/2002 DeJong et al. ..... 215/386

* cited by examiner

*Primary Examiner*—Lee Young
*Assistant Examiner*—Lien Ngo
(74) *Attorney, Agent, or Firm*—Gene Scott-Patent Law & Venture Group

(57) ABSTRACT

A molded baby bottle cap of a soft rubber and a molded water bottle cap of a hard plastic, the baby bottle cap providing an annular portion extending axially within the baby bottle cap. Plural molded circular ribs are engaged within the water bottle cap thereby interlocking the two caps. The apparatus is thus engagable with a baby bottle in a typical manner using a threaded compression ring, or with a water bottle using threads molded into the water bottle cap.

3 Claims, 2 Drawing Sheets

COMBINATION CAP FOR A BABY BOTTLE AND WATER BOTTLE

BACKGROUND OF THE INVENTION

1. Field of the Invention

This invention relates generally to bottles for feeding an infant or young child and more particularly to a bottle cap that is engagable with a baby bottle of the type for feeding formula, and also with a standard water bottle.

2. Description of Related Art

The following art defines the present state of this field:

Kwiecinski, U.S. Pat. No. 414,873 describes an infant nipple adapter system design.

Bullock, U.S. Pat. No. 2,461,561 describes a pipe fitting, a water meter reducing adapter comprising a sleeve of substantially uniform diameter throughout the greater portion of the length thereof and having a comparatively short unthreaded outer surface at one end with the remainder of the outer surface threaded from the unthreaded part to the opposite end of the fitting, said fitting having an internally threaded bore extending inwardly from the end thereof on which the said smooth surface is positioned, and a smooth bore of smaller diameter than that of the threaded bore forming an abutment to engage the end of a nipple extending from the meter providing uniform flow through the adapter, said smooth bore extending from the threaded bore to the opposite end of the fitting and aligned with the threaded bore.

Mills, U.S. Pat. No. 2,771,073 describes a device applicable to the neck of a thermally insulated bottle, including an elongate vertically disposed tubular plug instertable into the neck of the bottle and having a passageway extending longitudinally through it, a nipple having a mounting flange overlaying and engagable with the upper end of the plug, a fastener releasably retaining the flange engaged with the plug and including an annular collar threadedly engaged around the upper portion of the plug and having a radially inwardly projecting lip overlying the upper end of the plug and the mounting flange, and a closure releasably carried by the fastener and closing the passageway, the nipple being inverted and located in the passageway.

Roberson et al, U.S. Pat. No. 3,214,053 describes a cap for use with a flexible nipple, said cap comprising an end wall having spaced outer and inner surfaces an aperture formed in said end wall and adapted to receive said flexible nipple therethrough, a first vent channel formed in said outer surface, a second vent channel formed in said inner surface of said end wall in spaced relation to said first vent channel, and passage means for placing said vent channels of said inner and outer surfaces in fluid communication.

Dekerle, U.S. Pat. No. 5,024,341 describes a nipple end-piece adapter for a bottle having a threaded neck, and further comprising an inner threaded chimney adapted for cooperating with the thread of the neck of the bottle, a sidewall also threaded for receiving the ring of the end-piece and, in addition, a skirt connected to the chimney, shaped and positioned so that it cooperates sealingly with the internal face of the neck of the bottle when the adapter is fixed thereon by screwing its chimney on the neck.

Snyder, U.S. Pat. No. 5,253,900 describes a container conversion adapter for coupling a reservoir of hand held airbrushes to commercial liquid media containers which permits the user to utilize the commercial container as the airbrush liquid medial reservoir, thus eliminating the need to first transfer the liquid media from a commercial container to a second liquid media reservoir prior to airbrushing.

Dekerle, EP 0 395 464 describes an adapter having an interior, threaded duct suitable for interacting with the thread of the collar of the bottle, a similarly threaded lateral wall for receiving the collar of the nipple and, furthermore a skirt connected to the duct, shaped and positioned in a manner such that it interacts sealingly with the internal surface of the collar of the bottle when the adapter is attached to the latter by the screwing of its duct onto the said collar.

The prior art teaches the use of both baby bottle caps and water bottle caps of the type defined in the present invention, but does not teach the use of a combination cap that is alternately useable with either a baby bottle or a water bottle. The present invention fulfills these needs and provides further related advantages as described in the following summary.

SUMMARY OF THE INVENTION

The present invention teaches certain benefits in construction and use which give rise to the objectives described below.

Infants and young children are fed using a bottle with a rubber nipple. Typical feeding bottles are used for providing milk, formula, water and juice, for instance. It is desirable and usually necessary to feed a baby or infant with a baby bottle nipple that the child is familiar with. However, the typical baby bottle nipple cannot be easily adapted for use on the well-known and generally available bottles of water. One solution is to wash the baby's bottle out, transfer water into the baby's bottle and then feed the baby in this manner. However, when in public it is inconvenient and frequently impossible to wash the baby's bottle and also difficult to transfer water from a water bottle into the baby's bottle. A better solution is to mount the baby bottle nipple onto the water bottle directly. However, an examination of the type of water bottles that are available for purchase will immediately show that it is not possible to mount a baby bottle nipple onto a water bottle.

The present invention provides a superior solution. A molded baby bottle cap of a soft rubber and a molded water bottle cap of a hard plastic are interconnected by providing an annular portion of the baby bottle cap that extending axially within the baby bottle cap. Plural molded circular ribs are engaged within the water bottle cap thereby interlocking the two caps. The apparatus is thus engagable with a baby bottle in a typical manner using a threaded compression ring, or with a water bottle using threads molded into the water bottle cap that correspond with those molded into the neck of a water bottle.

A primary objective of the present invention is to provide an apparatus and method of use of such apparatus that provides advantages not taught by the prior art.

Another objective is to provide such an invention capable of alternative use with a baby bottle and with a water bottle, both of standard types.

A further objective is to provide such an invention capable of being molded as a single part.

A still further objective is to provide such an invention capable of being manufactured at relatively low cost.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention in at least one of its preferred embodiments, which is further defined in detail in the following description.

Figure 1:
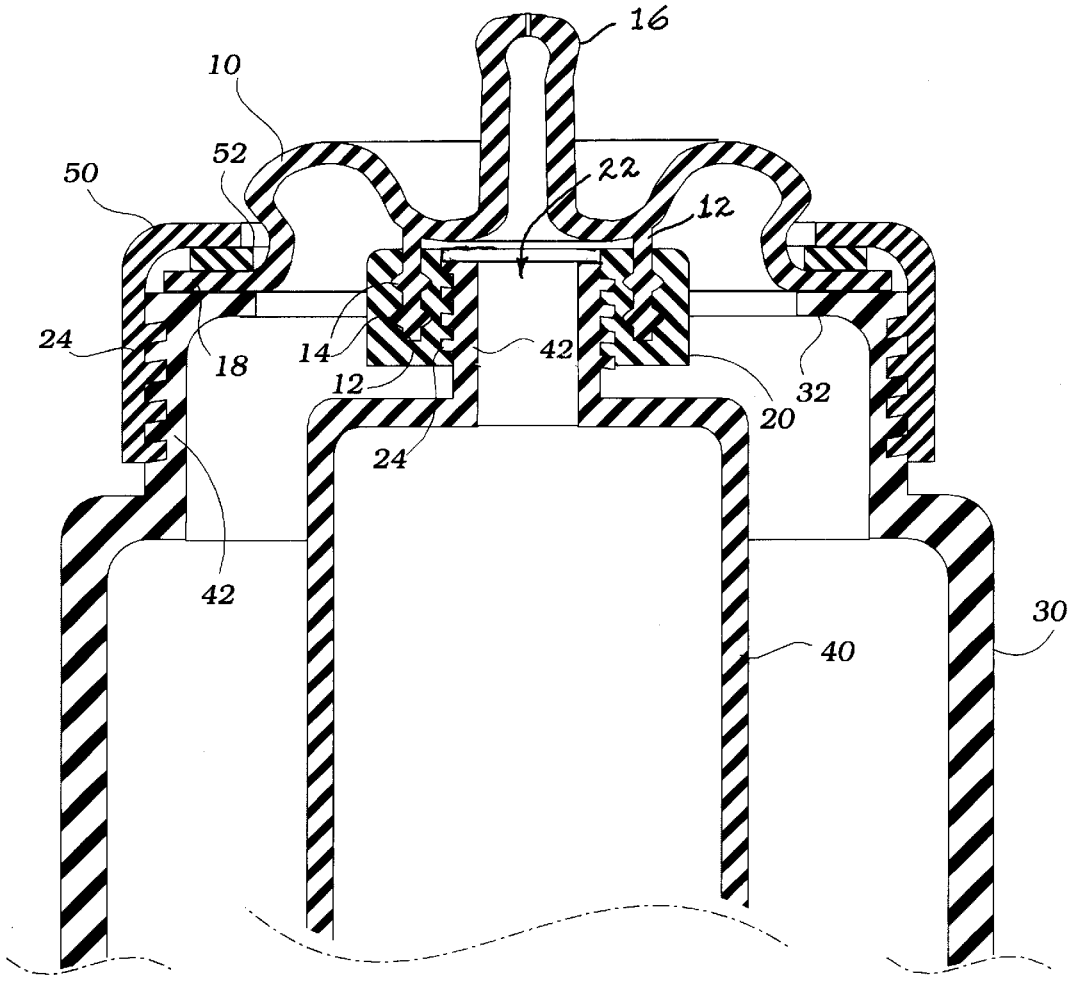
FIG. 1 is a vertical sectional view of the preferred embodiment of the invention, a capping device, defining engagement of a baby bottle and a water bottle thereto.
Figure 2:
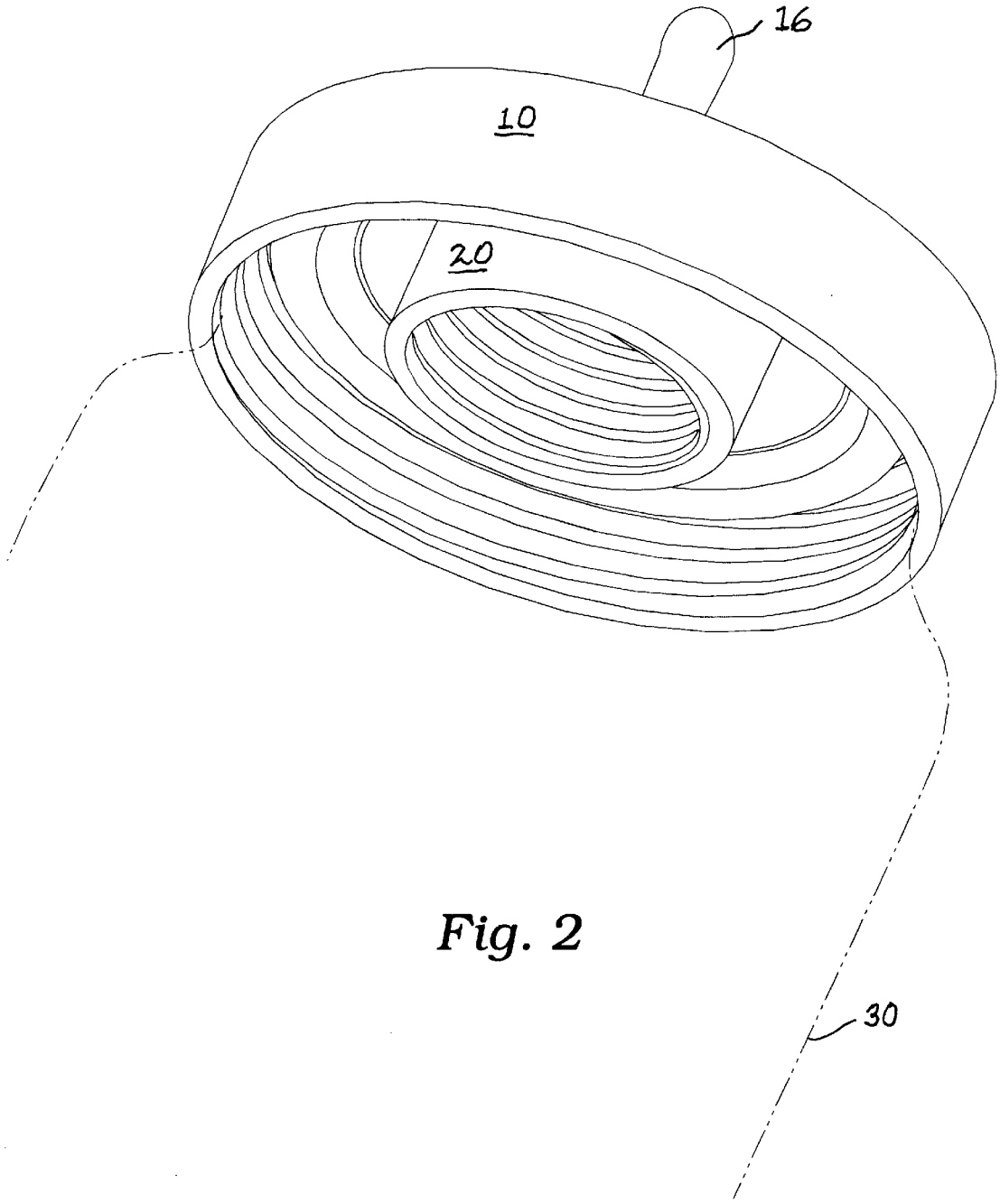
FIG. 2 is a perspective view thereof showing the baby bottle engagement but not the water bottle.

The present invention is an apparatus comprising in combination, a molded baby bottle cap 10 of a soft rubber and a molded and modified water bottle cap 20 of a hard plastic. The baby bottle cap 10 is of a typical and well known type as shown in the figures, and provides an annular portion 12 having one or more molded outcroppings, preferably plural circular ribs 14 that are engaged within the water bottle cap 20 and serve to interlock the two caps. The rubber used to fabricate the baby bottle cap 10 is of a silicone high temperature type so that it is able to withstand the thermal loads applied during the molding of the water bottle cap 20. The water bottle cap 20 provides an axially oriented through aperture 22 so as to enable water from the bottle 40 to pass through the water bottle cap 20 and into a nipple 16 of the baby bottle cap 10. The combination apparatus is engagable with a baby bottle 30 and with a water bottle 40 alternatively as is well shown in FIG. 1. FIG. 1 is not meant to infer that both bottles might be engaged with the capping device at the same time, but only that one or the other may be engaged with the capping device. FIG. 2 show the baby bottle engaging the capping device. The fabrication process involves, first molding the baby bottle cap 10 using a standard rubber injection molding process. When the baby bottle cap 10 has been completed, it is placed into a plastic injection-molding die and the water bottle cap 20 is then molded onto the baby bottle cap 10. The annular portion 12 of the baby bottle cap 10, with the molded circular ribs 14, extends into the plastic injection molding die so that it is enveloped and enclosed within, the water bottle cap 20. The circular ribs 14 interlock the two parts so that they cannot pull apart.

The water bottle 40 is engaged with the water bottle cap 20 using female screw threads 24 molded into the water bottle cap 20 and corresponding male screw threads 42 molded into the water bottle 40.

When used with a baby bottle 30, a baby bottle cap compression ring 50, as is well known, is engaged with the baby bottle 30, using a washer 52 and using female screw threads 24 molded into the compression ring 50 and corresponding male screw threads 42 molded into the baby bottle 30 so as to engage the baby bottle cap 10 with the baby bottle 30 in compressive axial alignment, i.e., a flange 18 of the baby bottle cap 10 is sandwiched between the washer 52 and the baby bottle's neck 32 as is well known.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus comprising: a molded baby bottle cap of a soft rubber; the baby bottle cap providing a nipple integral with, and extending upwardly from a circular flange, the flange extending laterally from the nipple, and further integral with the nipple and the flange, a cylindrical annular portion depending downwardly from the flange in axial alignment with the nipple; and a molded, ring shaped, water bottle cap of a hard plastic; the annular portion having plural circular ribs extending outwardly and inwardly therefrom; the ribs engaged within the water bottle cap for joining the two caps, the apparatus being engagable with a baby bottle and with a water bottle alternately.

2. The apparatus of claim 1 further comprising a water bottle engaged with the water bottle cap using female screw threads molded into the water bottle cap and corresponding male screw threads molded into the water bottle.

3. The apparatus of claim 1 further comprising a baby bottle cap compression ring, the compression ring engaged with a baby bottle using female screw threads molded into the compression ring and corresponding male screw threads molded into the baby bottle so as to engage the baby bottle cap with the baby bottle in compressive axial alignment.

* * * * *